US006663021B1

(12) United States Patent
Scarpa et al.

(10) Patent No.: US 6,663,021 B1
(45) **Date of Patent: *Dec. 16, 2003**

(54) PORTABLE CONVERGENT SPRAY GUN CAPABLE OF BEING HAND-HELD

(75) Inventors: Jack G. Scarpa, Huntsville, AL (US); John D. Marlin, Athens, AL (US); Terry Hall, Huntsville, AL (US); Steven A. Cosby, Rogersville, AL (US)

(73) Assignee: USBI Co., Kennedy Space Center, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/687,362

(22) Filed: Oct. 13, 2000

Related U.S. Application Data

(62) Division of application No. 09/394,289, filed on Sep. 10, 1999.

(51) Int. Cl.[7] ..... B05B 7/06

(52) U.S. Cl. ..... 239/424; 239/423; 239/422; 239/428; 239/432

(58) Field of Search ..... 239/407, 416.1, 239/416.4, 416.5, 417.3, 418, 419, 419.3, 422, 423, 424, 424.5, 428, 432, 533, 532, 587.1, 140

(56) References Cited

U.S. PATENT DOCUMENTS 1,779,849 A * 10/1930 Lusk
1,897,173 A * 2/1933 Long et al.
2,276,237 A * 3/1942 Lowry
2,388,517 A * 11/1945 Bailey et al.
2,520,397 A * 8/1950 Green
2,953,305 A * 9/1960 Bondurant
3,035,775 A * 5/1962 Edwards et al.
3,056,557 A * 10/1962 Walberg
3,185,396 A * 5/1965 Black
3,275,240 A 9/1966 Peaslee et al. ..... 239/61
3,795,364 A * 3/1974 Kattner
4,783,008 A * 11/1988 Ikeuchi et al.
4,795,096 A 1/1989 Smith ..... 239/288.3
5,322,564 A * 6/1994 Ludwig et al.
5,565,241 A * 10/1996 Mathias et al.
6,131,823 A * 10/2000 Langeman

FOREIGN PATENT DOCUMENTS

WO WO 96/09896 4/1996

* cited by examiner

*Primary Examiner*—Michael Mar
*Assistant Examiner*—Christopher Kim
(74) *Attorney, Agent, or Firm*—Norman Friedland

(57) ABSTRACT

A convergent type of spray gun is made portable by miniaturizing the components with the addition of a double tube, fluid tip and air cap for defining the discharge nozzle for the liquid resin and atomizing air. The dry powdered nozzle is likewise miniaturized and is adapted to fit over the double tube, fluid tip and air cap arrangement by including a sleeve disposed therebetween. The main body is configured in either an L-shape or straight-through configuration. Although the component parts are miniaturized, the spray gun is capable of flowing coating mixture at the same rate as the larger version convergent spray gun.

3 Claims, 8 Drawing Sheets

PORTABLE CONVERGENT SPRAY GUN CAPABLE OF BEING HAND-HELD

This application is a division of U.S. patent application Ser. No. 09/394,289, filed on Sep. 10, 1999, still pending.

CROSS REFERENCES

This invention relates to the subject matter disclosed in a contemporaneously filed co-pending patent application that is entitled "Convergent Spray Shut-Down System" by Scarpa et al, and which is commonly assigned, identified by Attorney Docket No. N804/ST-111 and incorporated herein by reference.

TECHNICAL FIELD

This invention relates to portable convergent spray guns for applying coatings to a surface and particularly to a portable spray gun that is miniaturized so as to be capable of being hand-held or having the option of being either hand-held or robotically-held for use with a portable system.

BACKGROUND OF THE INVENTION

U.S. Pat. Nos. 5,5645,241 granted to Mathias et al on Oct. 15, 1996 entitled "Convergent End Effector" and 5,579,998 granted to Hall et al on Dec. 3, 1996 entitled "Method For Coating A Substrate With A Reinforced Resin Matrix" of which the inventor Jack G. Scarpa is a co-inventor and which these patents and this patent application are commonly assigned. Both of these references disclose a spray gun that utilized a nozzle that is designed to configure the spray emitted by the nozzle into an atomized convergent plume of liquid resin and targets the plume with reinforced filler material downstream of the nozzle to mix and wet the filler just prior to being applied to the surface of the substrate. In other words the reinforcing material is entrained around the atomized liquid resin flow and is caused to be captured thereby, mix therewith and become an homogeneously wetted coating material that after impact with the substrates becomes cured into a substantially reasonably thick coating exhibiting good strength and resistance characteristics. The gaseous transport stream together with the eductor deliver the ingredients in the proper proportions and the air stream for causing the atomization and mixing to provide the proper amounts of material to assure that the coating is uniform and consistent. Heating is applied in the proper sequence to assure that the viscosity is at the proper level to assure evenness of flow and better atomization.

As one skilled in this technology would appreciate, the heretofore known spray application equipment for spraying of highly loaded paints and coatings which require the addition of a high volume of solid large granular materials such as cork, glass microsphers, granular or powdered materials in the 3 to 300 microns range require large amounts of solvents to dilute solid contents down to a level where it can be sprayed effectively. This, of necessity, requires special spray equipment designs that need to be significantly large in order to effectively spray these materials. Such systems have heretofore been designed to operate in a room or compartment that include a robot that was programmed to hold the spray gun and apply the spray. An additional room housed the supply of materials to be mixed and sprayed, the various valves, hoppers, proportioning devices and the like and separated from these rooms was a room that housed the computer equipment that served to control the various valves, proportioning devices etc, to automatically effectuate the spraying.

Co-pending patent application Ser. No. 08,/994,768 filed by Scarpa et al on Dec. 19, 1997 entitled "Portable Convergent Spray Gun For Applying Coatings" and also commonly assigned, exemplifies a convergent spray gun that is made into a portable unit. Like the spray guns described in the aforementioned patents which are typically held by a robot, it, likewise, is very large and as a matter of fact requires the spray apparatus to be formed as part of a wand that requires two hands to operable effectively.

These special very large spray equipment designs leads to very low actual transfer efficiencies for spraying these coating materials. These low transfer efficiencies have a significant impact on the quantities of materials, solvents and volatile organic compounds that are released into the environment. As one skilled in this technology will appreciate, from an ecology standpoint these conditions are not preferred as is recognized by the Environmental protection Agency and Occupational Safety and Health Administrations that are tightening regulations that mandate change.

While one would normally expect that in order to reduce the size of the gun and attain all of the features and particularly be able to apply the same amount of coating for each pass, one would merely have to reduce the size of each of the components of the heretofore known guns as for example, of the type exemplified in the aforementioned patents. However, merely reducing the size of the components will not realize a convergent spray gun that will effectively spray a coating and as a matter of fact such a design fails to meet the specifications for coatings that are required in the larger guns that are exemplified by the aforementioned patents and patent application. As a matter of fact, we have found that it was necessary to add additional components in order to reduce the overall size and weight of the gun so that it could be hand-held, that is, held by one hand in the same way that a commercially available paint spray gun is handled. This invention contemplates adding a concentric tube construction to the commercially available (modified to meet the needs of the present invention) spray nozzle, such as spray nozzles produced by Binks, Fanklin Park, Ill. and Graco, Detroit, Mich. that provides an inner tube that transports the resin and an outer tube that transports the air for atomizing the mixture and the dry powdered nozzle and its convergent cap. This arrangement of the concentric tubes allows the dry powdered nozzle that transports the dry powder material into a manifold to be propelled into the resin/air atomization plume. The dry granular materials and atomized resins become entrained at this point and thoroughly mix together outside the gun before being deposited on the substrate.

As is the case of the structure in the U.S. Pat. No. 5,307,992 granted to Hall et al on May 3, 1994 entitled "Method And System For Coating A Substrate With A Reinforced Resin Matrix" and commonly assigned, the U.S. Pat. No. 5,5645,241 patent, supra and the U.S. Pat. No. 5,579,998, supra, the present invention described in this patent application does not change the basic operation principles but provides a mini-gun that is capable of being hand-held for coating operations and is an improvement in ergonomic design over heretofore convergent types of guns. As mentioned above, the gun made in accordance with this invention, is also capable of use in a fully robotically automated system of the type already in operation and also can be used for incorporation for completely portable convergent nozzle spray gun systems.

What is afforded by this invention and not by way of limitation are the following features:

1) Solventless application of thermal protection coatings;

2) Compatible with solvent borne epoxy, polyurethane, silicate, waterbased or 100% solid resin systems;

3) Ability to accurately control thickness of applied coatings by robotics or hand-held;

4) Ability to control dimensions of area to be coated;

5) Ability to control both dry filler and resin filled material independently;

6) Enhanced ability to apply coatings to smaller parts and enclosures;

(7) Ability to reduce the required passes to attain the desired thickness;

(8) Significant reduction in waste and hazardous materials.

(9) Significant reduction in solvents; and

(10) Ability to control density.

SUMMARY OF THE INVENTION

An object of this invention is to provide an improved mini-convergent spray gun that is characterized as being capable of being held in the user's hand.

A feature of this invention is that it incorporates a concentric tube assembly communicating with a commercially available spray gun that transports the resin and air to a reduced sized dry powdered nozzle and convergent end-effector for injecting a dry powder in the convergent atomized resin spray at the exterior of the resin discharge orifice.

A still further object of this invention is to provide a convergent type of spray gun that is capable of being hand-held that is characterized as being capable of thermal protection coatings with the absence of a solvent, and is compatible with epoxy, silicone, polyurethane, silicate, water based or 100% resin systems; has the capability of controlling the thickness and the dimensions of the area of the applied coatings; has the ability to control both dry filler and resin filled material independently; to apply the coatings to smaller parts and enclosure and reduce the number of passes to attain the desired thickness of the coating, reduce the amount of hazardous materials and solvents while being capable of controlling density.

The foregoing and other features of the present invention will become more apparent from the following description and accompanying drawings.

BRIEF DESCRIPTION OF THE DRAWINGS

FIG. 9 is a alternate embodiment of the portable spray gun that is substantially the same as the embodiment depicted in FIG. 8 save for the fact that this embodiment is straight through.

These figures merely serve to further clarify and illustrate the present invention and are not intended to limit the scope thereof.

BEST MODE FOR CARRYING OUT THE INVENTION

As noted in the above paragraphs, the system for supplying the desired ingredients for the coating is described in U.S. Pat. No. 5,307,992, supra and the system for supplying these ingredients to the spray gun of this invention is substantially the same. In one version, the resin and catalysts (resin) are mixed in the paddled mixer that is disposed in the gun and in the other version the resin and catalyst are mixed in a static mixer disposed upstream of the spray gun and both system will be fully described hereinbelow. The dry materials such as cork or glass micro spheres are transported by a controlled dry hopper loss-in-weight or mass loss feeding system that fees into educted pneumatic tubes that transports the material to a cyclonic mixer and then to the Convergent End-Effector nozzle. The wet epoxy resin material such as 3M 2216 which is commercially available or other suitable epoxy or polyurethane systems of various ratio is transported by means of pressure pots. The components of the resin is regulated to a desired ratio by a suitable commercially available proportioning system. Such systems are available, for example, from the Zenith Pump division of Parker Hannifin Corporation of Sanford, N.C. or from the Moyno division of Robin & Myer of Dayton, Ohio. These proportioning systems or any other type of commercially available proportioning systems that are usable in this system are designed to proportion the two components of the resin and meter the same to a suitable mixer either of the dynamic or static type prior to being flowed to the discharge nozzles of the spray gun. The system serves to control all the valves, air and resin flows by a suitable analog panel which is controlled by a suitable I/O control processor of a general purpose type of computer. To better understand this invention the nomenclature of the component parts are defined as follows:

Convergent End Effector nozzle—is the discharge end of the gun where the resin and air are atomized and converged and the dry powder is introduced through the dry powdered nozzle.

Dry powdered nozzle is the nozzle that feeds the dry powder into the plume of the atomized resin.

Convergent cap is the cap mounted on the end of the dry powdered nozzle that defines the discharge orifice.

Nozzle is any discharge orifice that discharges flow in a prescribed manner.

Figure 3:
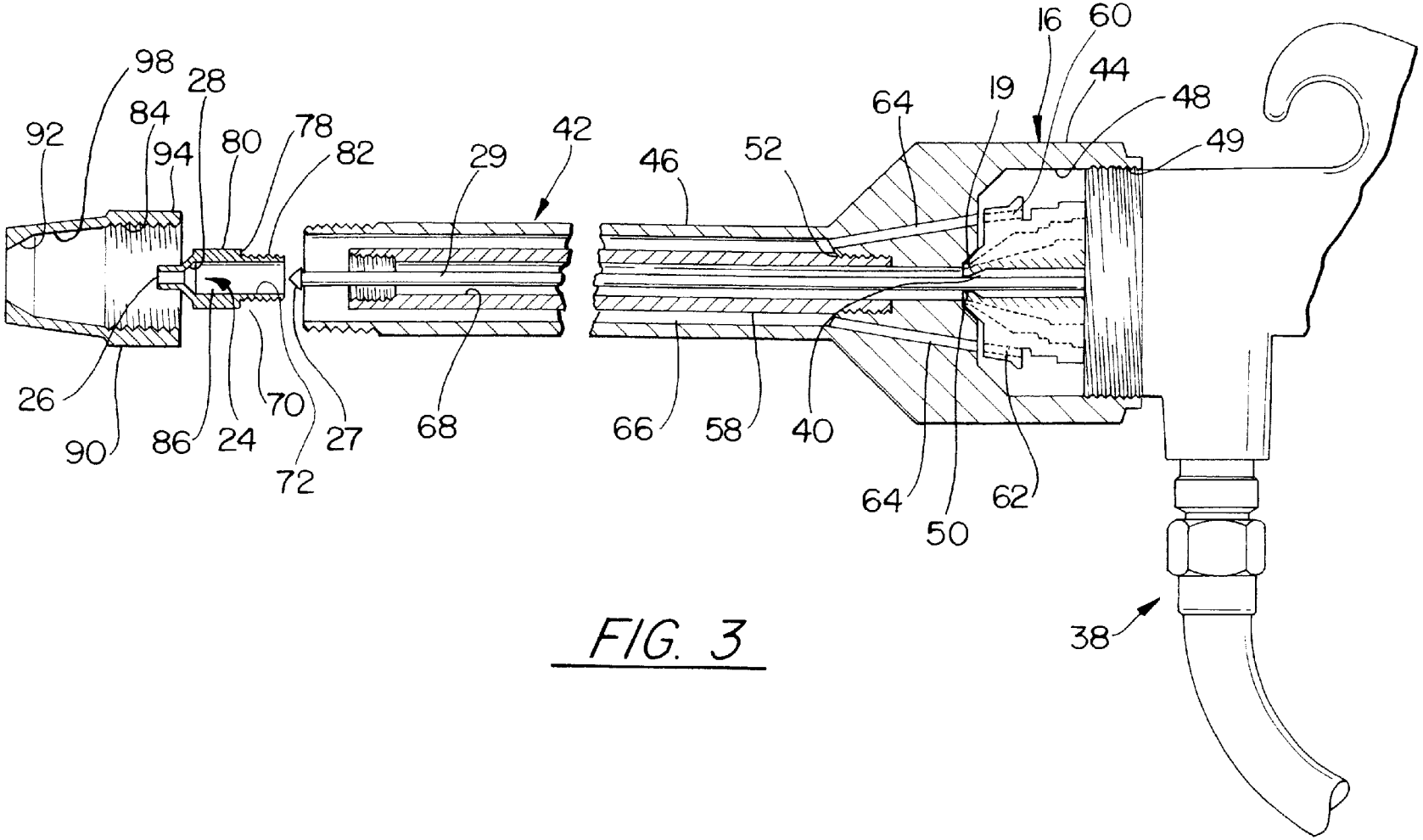
FIG. 3 is a diagrammatic view in section of the concentric tube assembly of this invention.

The invention can best be understood by referring to FIGS. 1–7 which shows the convergent spray gun generally illustrated by reference numeral 10 as being comprised of a commercially available Binks gun or of the type of gun described in U.S. Pat. No. 2,971,700 granted to Peeps on Feb. 14, 1961 entitled "Apparatus For Coating Articles With Chemically Reactive Liquids" (which is incorporated herein by reference) generally illustrated by reference numeral 12 and modified for meeting the requirements of this invention, the dry powered nozzle 14 and the concentric tube assembly generally illustrated by reference numeral 16. The commercially available Binks gun which essentially is an L-shaped main body 17 having appropriate passages for flowing the air and resin to a convergent nozzle 19 is modified to accommodate this invention by including a receiving box 18. Receiving box 18 includes fittings for transmitting air into inlet 20 and then into the inlet 21 of the spray gun 10, fittings for transmitting the dry powder into inlet 22 where it is split by any type of splitter (not shown) into two streams for flowing the dry powder through the discharge fittings 23 and 25 and the valve 24 (see FIG. 3). Trigger 30 is suitably mounted adjacent the handle 31 and is conveniently available for operation for actuating the gun to turn the spray of coating on and off. The fitting 38 serves to receive the mixed resin delivered thereto from a suitable pressurized source and flows through a passage formed in the spray gun 10 and discharges though the central orifice 26 as will be described in detail hereinbelow. In addition to the modification of the Binks gun described above, a fluid tip of the type known as a Paasche tip that is commercially available and as best seen in FIG. 3 is designed to include valve 24 that is manually operated by the trigger 30. Valve 24 may be located adjacent to the central orifice 26 discharging the resin and includes seat 28 surrounding the orifice 26 and the valve body 27 connected to the valve stem 29 for rectilinear movement by actuation of the trigger 30 for opening and closing the discharge orifice 26 of the spray gun 10. Alternatively the valve 24 may be located adjacent to orifice 40. In the alternative embodiment the same or similar parts constituting the valve mechanism would be utilized in this location.

Figure 4:
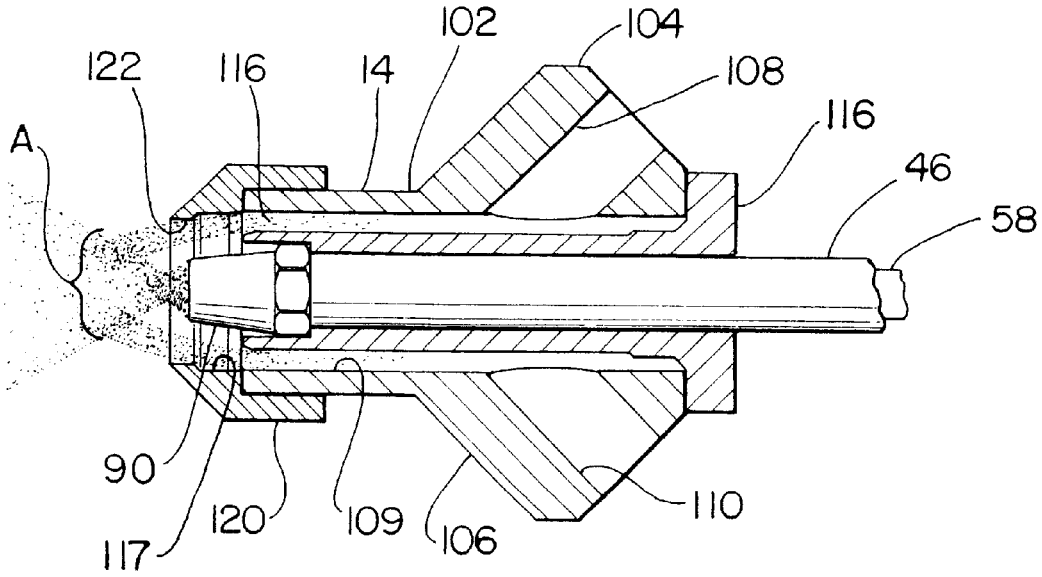
FIG. 4 is a partial view partly in section and partly in elevation taken along the longitudinal axis of the concentric tubes of FIG. 1.
Figure 5:
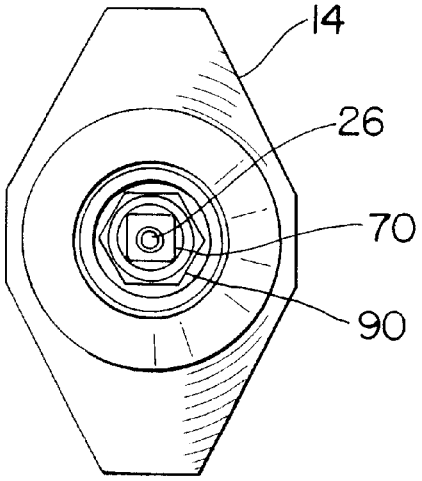
FIG. 5 is plan view of the front end of the dry powdered nozzle of the spray gun depicted in FIG. 1.
Figure 6:
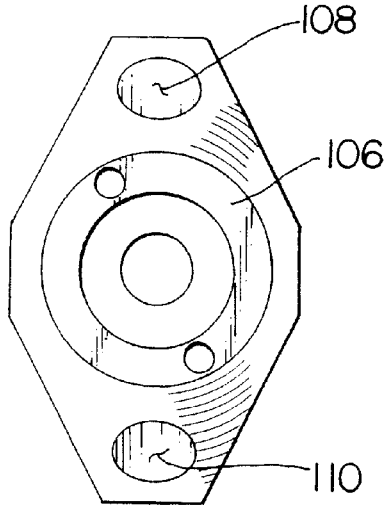
FIG. 6 is a plan view of the aft end of the dry powdered nozzle of the spray gun depicted in FIG. 1.

Referring next to FIGS. 4–6, the dry powdered nozzle 14 mounted on the concentric tube assembly 16 includes a pair of diametrically opposed fittings 32 and 34 adapted to receive suitable tubing for conveying the dry powder flowing through the fittings into the manifold of the dry powered nozzle that will be described hereinbelow.

As was mentioned above, the L-shaped spray gun 10 is capable of being miniaturized from the heretofore known convergent spray guns not merely because the components are made smaller, which is partially the case, but because of the modification to the Binks type of gun and the addition of the inner and outer extension tubes of the concentric tube assembly 16 which will be described in more detail hereinbelow. As best seen in FIG. 3, the modified Binks gun 12 includes the central orifice 40 that is fluidly connected to the inlet of the fitting 38 for flowing the resin toward the discharge end of the spray gun. The outer tube 42 includes a large diameter hollow conically shaped portion 44 that fairs into a smaller diameter tubular portion 46 that extends axially toward the fore end of the spray gun. The aft end of the outer tube 42 is threadably connected to the end of the modified Binks gun by the complementary threads 49 so that the cavity 48 defined by the conically shaped large diameter portion 44 surrounds the tip 50 of the modified Binks gun. Inner tubular member 58 is threadably attached to the outer tube 44 by the complementary threads 52 and, like the tubular portion 46 of the outer tube 42, extends axially toward the tip of the spray gun 10 and lines up with orifice 40 of nozzle 19 to continue the flow of resin toward the central discharge orifice 26. As is apparent from the foregoing the resin is transported toward the tip of the spray gun 10 through the inner tubular member 58 and atomizing air discharging from the circumferentially spaced air discharge holes 60 and 62 of the Binks gun is transported through the outer tubular member 42 via the centrally disposed drilled passages 64 and the annular passage 66. The tip of the spray gun 10 is defined by the fluid tip element 70 that includes a central passage 72 terminating in a discharge central orifice 26 and the air cap 90, (the air cap may be a commercially available air cap of the Paasche type), both of which serve to create a conically shaped convergent plume A (see FIG. 4) at the exterior thereof. The fluid tip element 70 includes a main body 78 which is circular in cross section and is dimensioned so that its diameter is substantially equal to the inner diameter of the tubular portion 46 and several (up to four) segments or secants to the circular cross section are milled or cut at the larger diameter portion 80 to form flats that leave a gap between the fluid tip element 70 and the annular passage 66 (See FIG. 3). This gap serves to meter, direct and atomize the air in the annular passage 66. As can best be seen in FIG. 3, the aft end 82 of the fluid tip element 70 extends axially rearwardly and is threaded to complement the threads formed on the end of the inner tubular member 58 to form a tight fit and communicate the central orifice 84 with the passage 86 formed in the fluid tip element 70 which, in turn, communicates with the passage 68 of the inner tubular member 58 for flowing resin to discharge through central orifice 84.

Air cap 90 includes a conical inner surface 92 and a threaded aft end 94 that threadably engages the complementary threads formed on the outer end of the outer tubular member 46 and serves to surround the fluid tip element 70. The air cap 90 serves to converge the atomized air toward the discharge end of central orifice 84 so that the resin flowing through passage 68 into the reduced diameter portion of central passage 86 to increase the dynamic head of the resin and cause it to be accelerated and expand as it is being discharged. The air discharging from the convergent surface 92 of air cap is formed in a highly atomized spray that mixes intensely with the resin as it discharges from orifice 84 and forms a stream of small particles accelerating toward the target. The mixed atomized air and resin are discharged so as to define a plume immediately downstream of the central aperture 98 formed in the air cap 90 where the dry powder is injected as will be explained hereinbelow.

The dry powdered nozzle 14 as shown in FIGS. 4–6 consists of a main cylindrically shaped body 102 having angularly disposed extension portions 104 and 106 and includes a central straight through bore 109 communicating with the drilled passages 108 and 110 angularly disposed relative thereto formed in the extension portions 104 and 106, respectively. The dry powdered nozzle 14 is fitted over the sleeve 106 that is concentrically and coaxially disposed relative to the fluid tip 70 and the tubular member 46 and tubular member 58 of the concentric tube assembly 16. Convergent cap 120 is frictionally fitted or fitted in any suitable manner at the aft end of the dry powdered nozzle cap 14 and includes a nozzle 122 defined by the convergent cap 120 that directs the flow of dry powder from the dry powdered nozzle 14 into the plume A ( as shown in FIG. 3). The annular space between the sleeve 106 and the inner diameter of the main body 102 of the dry powdered nozzle 14 define an annular manifold 116 where the powder is transmitted and streamlined just prior to being injected into the low pressure zone of the atomized plume A (FIG. 4). These elements just described, namely the air cap 90, fluid tip 70 and dry powdered nozzle 14, form the end-effector of the convergent spray gun. While the end-effector of the present invention functions similarly to the end-effector shown in U.S. Pat. No. 5,307,992, supra, because of the incorporation of the concentric tube assembly 16, the dry powdered nozzle 14 and convergent cap 120 is made significantly smaller than the heretofore designs while at the same time being comparable to the volume of flow of the ingredients emitted at the discharge end of the spray gun.

Figure 6A:
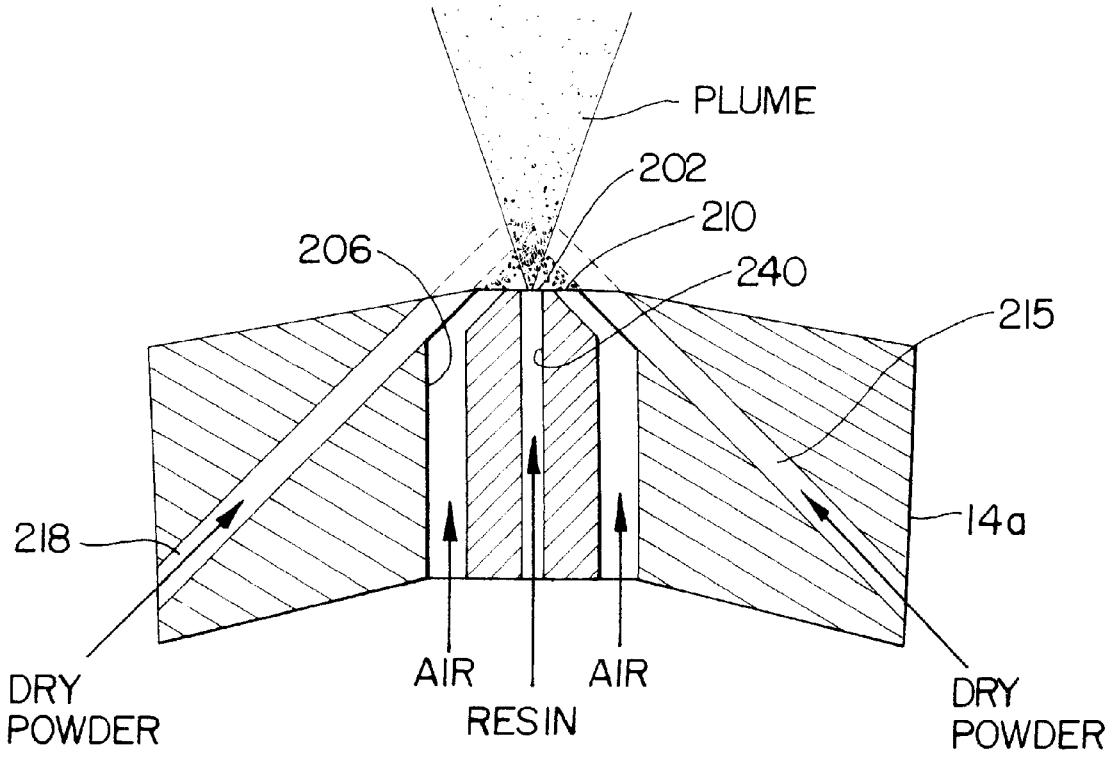
FIG. 6A is a is a sectional view of an alternate embodiment of the dry powdered nozzle for use with the spray gun depicted in FIG. 1.

FIG. 6A exemplifies another embodiment of the dry powdered nozzle 14*a* that includes the central passage 200 (the same reference numeral with a subscript is used to depict similar parts in all the Figures) for flowing the liquid resin that discharges through central orifice 202, the annular air passages 206 that discharge the air through the annular orifice 210 at an angle to converge with and atomize the resin and the diametrically opposed dry powdered passages 215 and 218 that directly feed into the low pressure zone of the plume of the atomized air/resin stream. It will be appreciated that the configuration of the dry powdered nozzle 14 depicted in FIGS. 5 and 6 is designed to accommodate the larger granular sized particles of dry powder, while the dry powdered nozzle 14*a* depicted in FIG. 6A is preferably designed for a finer dry powder granular.

Figure 7:
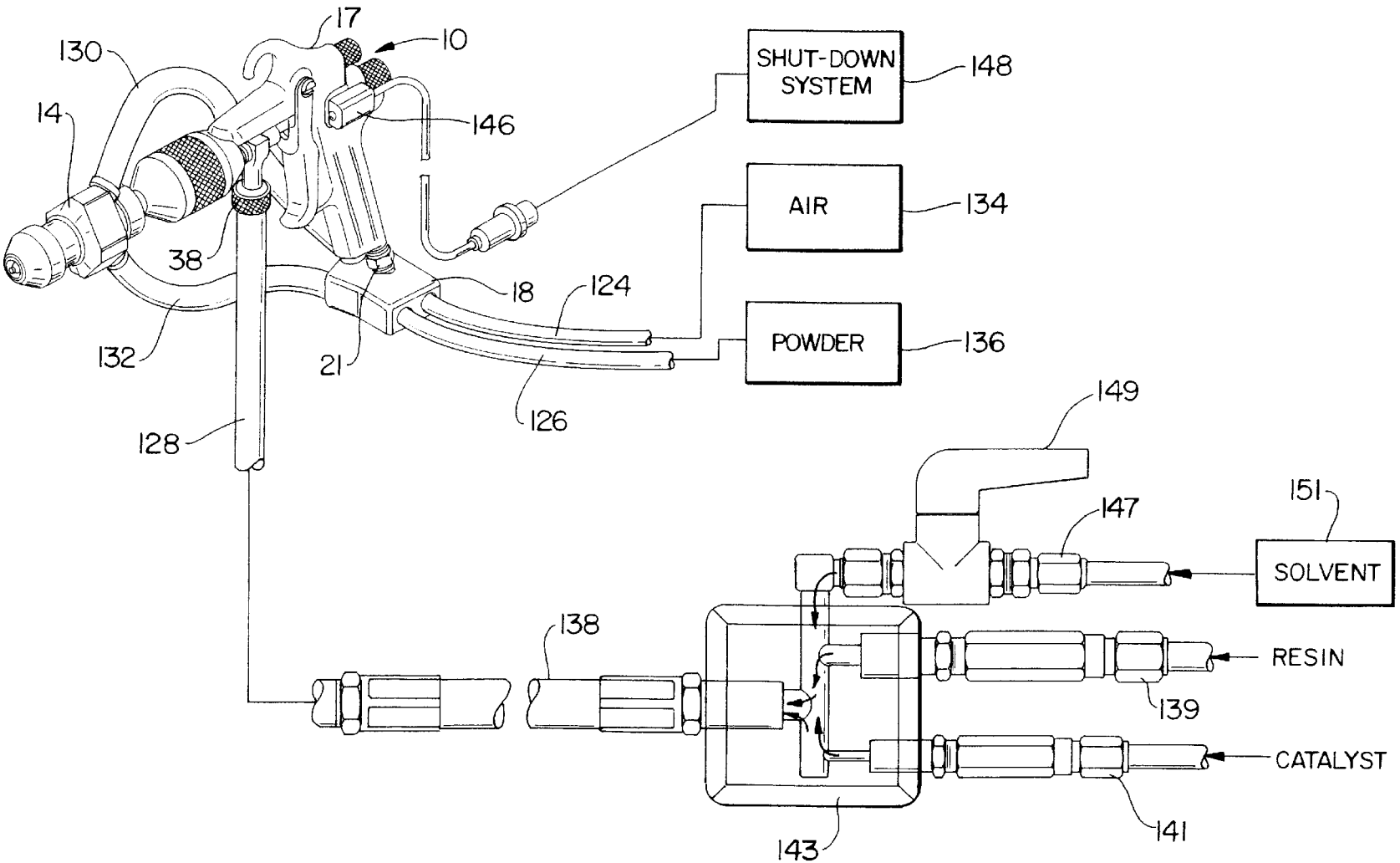
FIG. 7 is a perspective view of the spray gun depicted in FIG. 1 and a schematic illustration of the system utilized therewith.

In operation, and as seen in Fig.7, suitable commercially available hose 124 interconnects the spray gun 10 to the high pressurized air source 134 via the receiving box 18. The powder and low pressure air for transporting the same is represented by box 136 which is also transported to the spray gun 10 via receiving box 18 where it is split and transported to the dry powder nozzle 14 or 14*a*. The static mixture 138 (which may be a suitable Hirsch tube) that supplies the resin (which in this embodiment is made from two components, resin and catalyst) to the spray gun 10 via line 128. The catalyst and resin are admitted into mixer 138 from manifold 143 which receives these components through lines 139 and 141, respectively. A proximity switch 146 may be added and connects with the shut-down system 148 which is the subject matter of the co-pending patent application mentioned in the Cross-Reference of this patent application.

The miniaturized gun 10 is sufficiently small and light in weight so as to be easily handled by a user much in the same manner that a commercially available powered paint spray gun is used. Actuation of the trigger 30 simultaneously opens and closes valve 24 and turns on the computer, valves, proportioning devices, pneumatic devices, for flowing and stopping the flow the ingredients being delivered to the gun. A solvent in reservoir 151 is admitted into the resin flow lines via the mixer 138 via line 147 and a suitable on/off valve 149. The solvent is admitted into the manifold 143 and flows through the resin lines in the gun to assure that the resin that is captured therein when the gun is shut off doesn't cure and become hardened.

As mentioned in the above-paragraphs the volume of ingredients emitted from the gun corresponds to the larger and heavier convergent spray guns that are known. The spray gun made in accordance with this invention also is not only capable of being hand-held but is also capable of applying thermal protection coatings with the absence of a solvent, and is compatible with epoxy, polyurethane, silicate, water based or 100% resin systems, and has the capability of controlling the thickness and the dimensions of the area of the applied coatings, has the ability to control both dry filler and resin filled material independently, to apply the coatings to smaller parts and enclosures and is capable of reducing the number of passes to attain the desired thickness of the coating, while at the same time reduce the amount of hazardous materials and solvents while being capable of controlling density.

Figure 8:
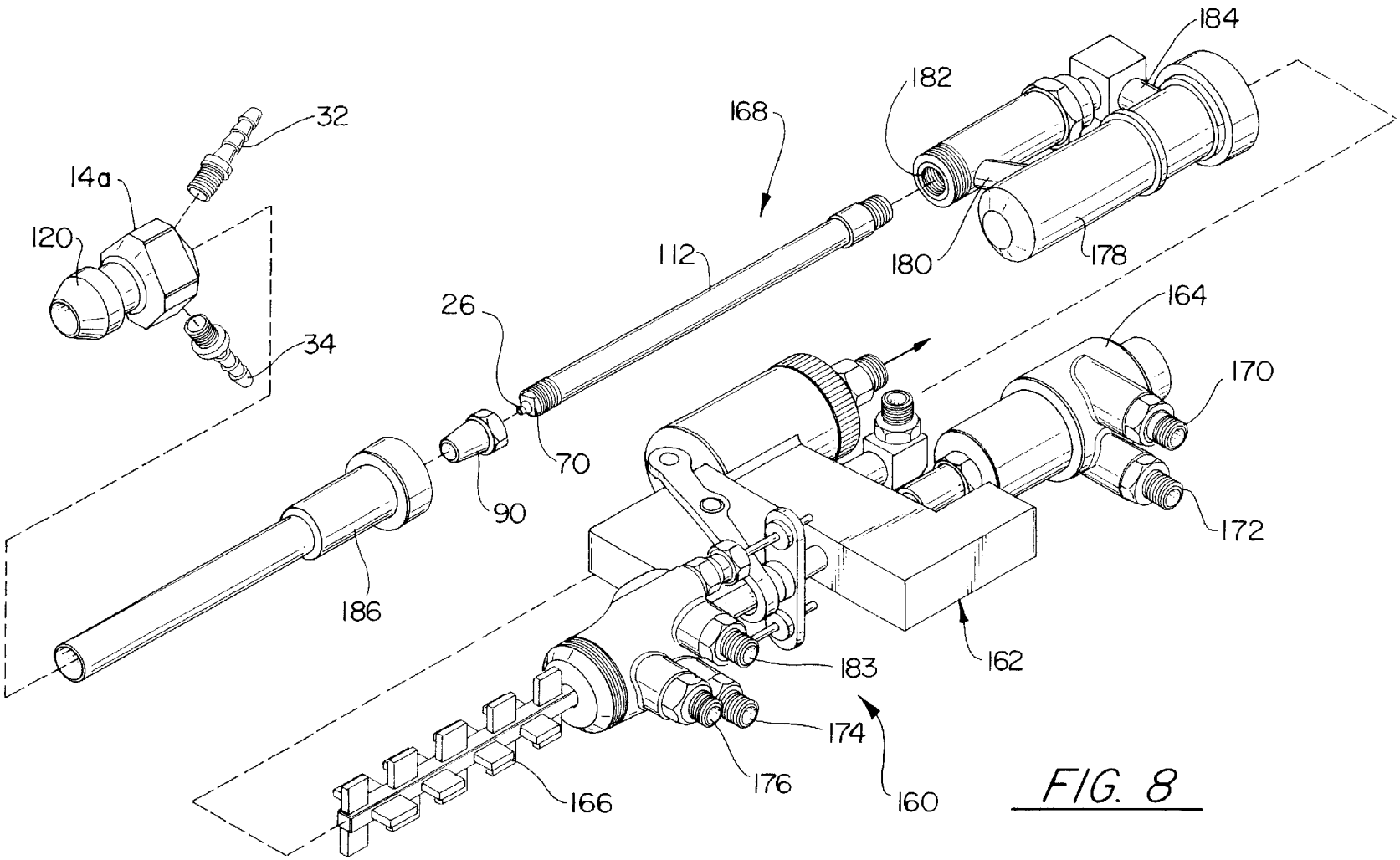
FIG. 8 exemplifies another version of this invention shown in an exploded view of a prototype portable miniaturized convergent spray gun configuration.

FIG. 8 exemplifies another version of this invention and is a prototype of a modified robotically held spray gun that is miniaturized so as to be capable of being hand-held similar to the version depicted in FIGS. 1–7 and is available for a portable system. The spray gun generally illustrated by reference numeral 160 which as mentioned above is a prototype of a spray gun cobbled up from a robotically held spray gun and is miniaturized for hand-held operation or for a portable system and includes a modified Binks gun 162 that is commercially available, an air motor 164, a paddle mixer 166 and the concentric tube assembly 168, the fluid tip 70 (like reference numerals used in all the Figures depict like or similar elements), air cap 90, and the dry powdered nozzle 14. As noted in the version depicted in FIGS. 1–7 instead of the static mixer upstream of the spray gun 10 being utilized, in this version a paddle mixer 166 is utilized, noting that either version of the spray guns may utilized either type of mixer. The paddle mixer 166 of is driven by the air motor of the Binks gun which is powered by the pressurized air flowing into the gun through inlet 170 and discharging through the outlet 172 and mixes the resin (double type) fed thereto through inlet fittings 174 and 176. The mixed resin after being acted on by the paddled mixer 166 flows through the housing 178, cross-over tube 180 and into the inner tubular member 182 and discharges through the central orifice 26 formed on the end of the fluid tip 70. Air cap 90 that fits over the fluid tip 70 receives pressurized air from the inlet 182 and flows through inner passages formed in the housing 178 and into the cross-over tube 185 and into the annular passage formed between the inner diameter of outer tubular member 186 and the outer diameter of inner tubular member 112. The dry powdered nozzle 14 fits over the end of the reduced diameter portion of outer tubular member 186 and injects the dry powder from the manifold and convergent cap 120 into the wetted resin atomized plume A (similar to FIG. 3). The spray gun operates in much of the same way as the version in FIGS. 1–7, where the operator depresses a suitable switch that actuates the system of values, proportionate devices, eductors, pneumatic conveying equipment controlled by the computer which turns the system on and off. Turning the system on flows the proper proportion of resin, dry powder, atomizing air and pressurized motor air to the gun 160 for actuating the paddle mixer 166 and the valves in the gun to generate the atomized convergent plume of wetted resin and drive the dry powdered nozzle to inject the dry powder into the plume in the manner described in connection with the spray gun depicted in FIGS. 1–7.

Figure 1:
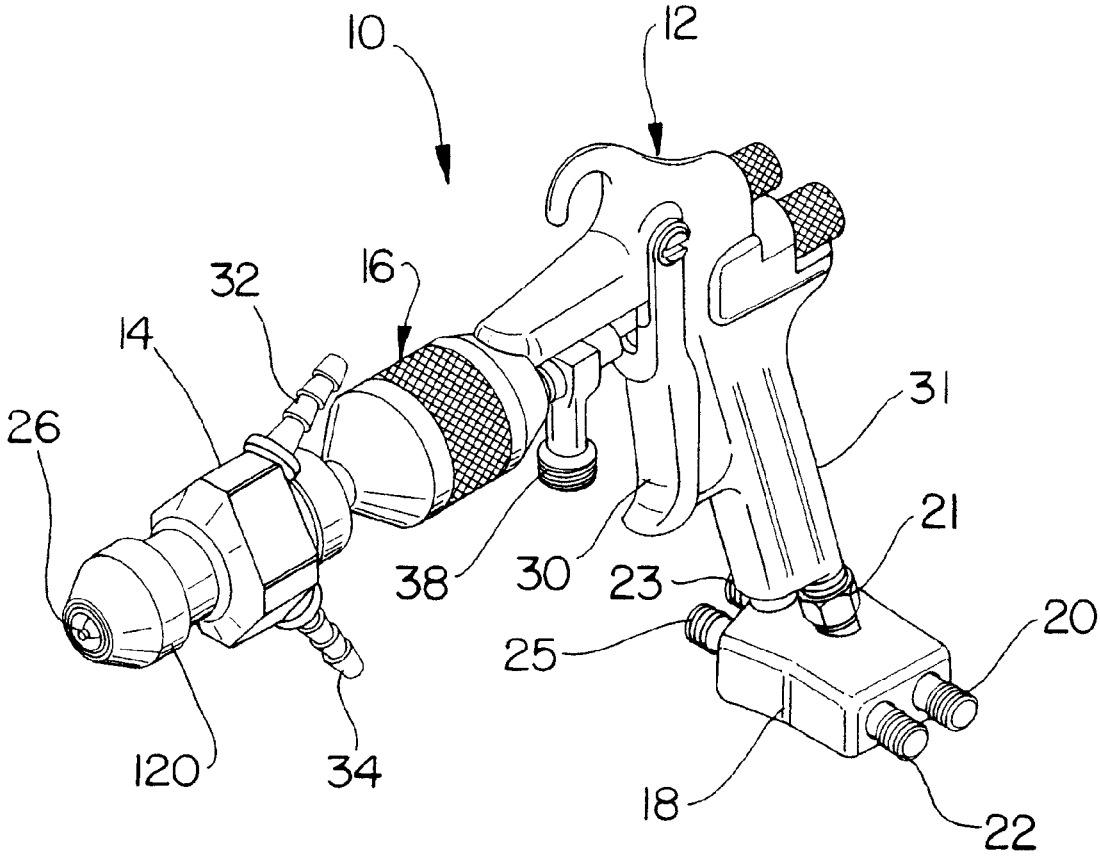
FIG. 1 is a perspective view of the miniaturized spray gun of this invention.
Figure 2:
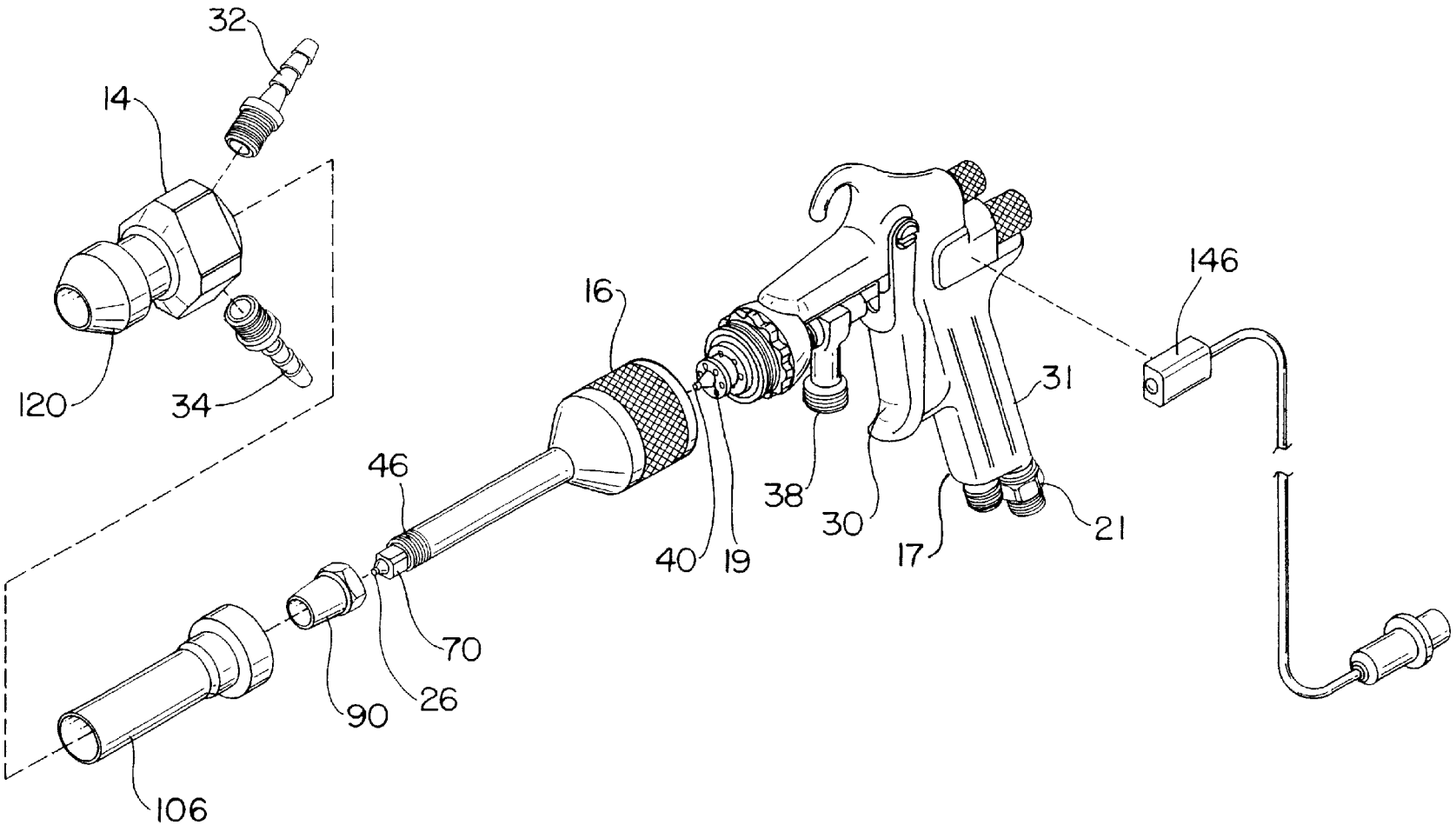
FIG. 2 is an exploded view showing the component parts of the invention comprising the miniaturized convergent spray gun of FIG. 1.
Figure 9:
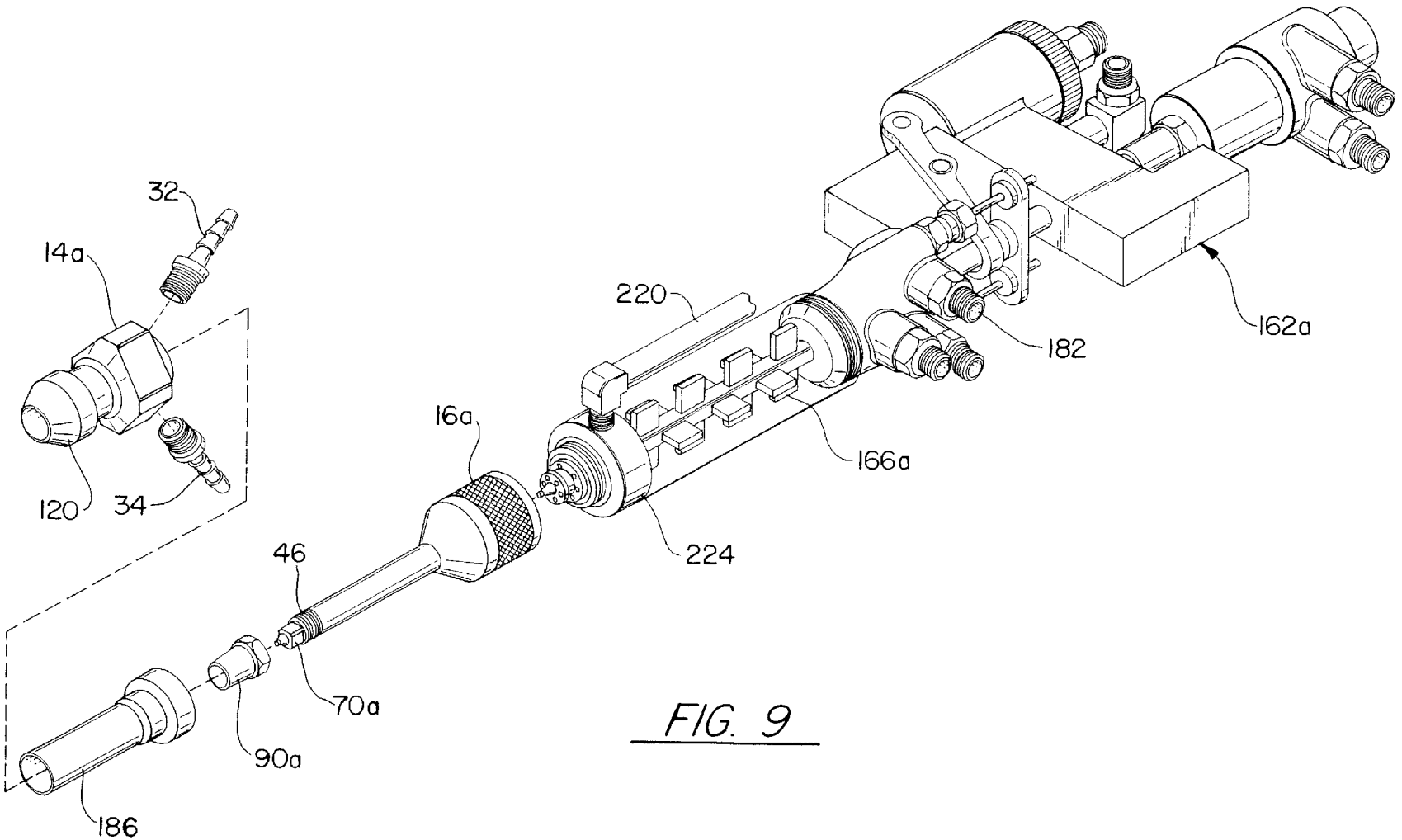

The version of the spray gun exemplified in FIG. 9 is a combination of the elements that constitute the spray gun depicted in FIGS. 1 and 8, where the Binks gun and Paache tubes are modified to miniaturize the spray gun. Obviously, because the handle takes the elongated shape rather than the pistol shape, the spray gun is better suited for use with the robot. However, since the parts are miniaturized, the spray gun is more appealing to be used in a portable spray system rather than the separate room arrangement that is typical for this type of coating application. In the FIG. 9 version the spray gun utilizes a commercially available Binks gun 162*a* with all of the same flow passages for the air and resin and includes a similar paddle mixer 166*a*. This Binks gun is modified to include an air conduit 220 that interconnect the air passage in the Binks gun with a manifold 224 that is mounted on the end of the paddle mixer 166*a*. The manifold directs the air around the resin without co-mingling therewith and flows in the outer tube of the the double tube configuration 16*a*. This portion of the gun is virtually identical to the forward portion of the spray gun depicted in FIGS. 2, 3 and 4 and reference should be made thereto for details of the components thereof. The unit comprises the double concentric tubes 16*a* for passing the resin and air to the discharge nozzle of the spray gun through the fluid tip element 70*a* and into the air cap 90*a*. The sleeve 116*a* that fits over the double concentric tubes 16*a*, fluid tip element 70*a* and air cap 90*a* accommodates the dry powder nozzle

14*a* for passing the dry powder into the atomized air/resin stream discharging from the tip of the spray gun. Like in the other spray gun versions the dry powder nozzle configuration depicted in FIG. 6A can be substituted for the dry powder nozzle 14 depicted in this embodiment.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. A portable convergent miniaturized spray gun including a handle having a central passage for flowing liquid resin and a catalyst and a concentric passage relative to the central passage for flowing pressurized air, and a nozzle internal of said spray gun for discharging the liquid resin from the central passage, a double concentric tube assembly having an additional central passage in axial alignment with said central passage for receiving resin from said internal nozzle, an additional concentric passage relative to said central passage in axial alignment with said concentric passage, a fluid tip mounted on the end of said additional central passage defining a central orifice for discharging the resin flowing from said central passage and said additional central passage, an air cap mounted over said fluid tip and defining therewith an air nozzle for flowing air from said concentric passage into said resin stream discharging from said central orifice and defining an atomized convergent spray having a low pressure zone and a dry powdered nozzle having angled flow passages for directing dry powder into the low pressure zone of said atomized convergent spray, said spray gun having a straight-through main body, a mixer in said main body having a plurality of paddles, said mixer being in communication with said central passage for mixing the resin and catalyst, and being connected to said additional central passage.

2. A portable convergent miniaturized spray gun as claimed in claim 1, including a sleeve surrounding said double concentric tube assembly and defining a manifold, said dry powdered nozzle including diametrically opposed passages disposed relative to said additional central passage communicating with said manifold for leading dry powder from said diametrically opposed passages to the orifice formed on the end of said dry powdered nozzle and directing said dry powder to the low pressure zone.

3. A portable convergent miniaturized spray gun as claimed in claim 1, wherein said dry powdered nozzle including diametrically opposed passages disposed relative to said additional central passage for directing said dry powder directly into the low pressure zone.

* * * * *